US007373742B2

(12) United States Patent
Murphy

(10) Patent No.: US 7,373,742 B2
(45) Date of Patent: May 20, 2008

(54) SKATE BOOT CONSTRUCTION WITH 3-D HEEL POCKET

(75) Inventor: Stephen Murphy, Ile Bizard (CA)

(73) Assignee: Sport Maska Inc., Quebec (CA)

( * ) Notice: Subject to any disclaimer, the term of this patent is extended or adjusted under 35 U.S.C. 154(b) by 88 days.

(21) Appl. No.: 11/067,019

(22) Filed: Feb. 25, 2005

(65) Prior Publication Data

US 2005/0193594 A1 Sep. 8, 2005

(51) Int. Cl.
*A43B 5/16* (2006.01)
*A43B 7/20* (2006.01)

(52) U.S. Cl. ..... 36/115; 36/89

(58) Field of Classification Search ..... 36/115, 36/89

See application file for complete search history.

(56) References Cited

U.S. PATENT DOCUMENTS 2,774,152 A * 12/1956 Alber ..... 36/71
2,830,585 A * 4/1958 Weiss ..... 36/71
3,758,964 A * 9/1973 Nishimura ..... 36/117.6
4,385,456 A * 5/1983 Livernois et al. ..... 36/115
4,724,627 A * 2/1988 Sisco ..... 36/117.6
6,079,128 A * 6/2000 Hoshizaki et al. ..... 36/89
6,550,159 B1 * 4/2003 Madore ..... 36/115

* cited by examiner

*Primary Examiner*—Ted Kavanaugh
(74) *Attorney, Agent, or Firm*—Seyfarth Shaw LLP

(57) ABSTRACT

The present invention is directed to a 3-D insert to be disposed in a skate boot so as to eliminate or reduce the gap between the posterior section of the Achille's heel and the boot liner.

8 Claims, 11 Drawing Sheets

SKATE BOOT CONSTRUCTION WITH 3-D HEEL POCKET

BACKGROUND OF THE INVENTION

The present invention pertains to a boot construction, especially for ice hockey skates, but which may be suitably adapted to other footwear applications such as in-line roller skates, hiking boots, etc. The present invention, by way of example only, will be described hereinafter in relation to ice hockey skate boots, but it is understood that the invention herein described and claimed may be suitably adapted to other boot applications.

At present, ice hockey skate boots use, in order to protect the wearer, ankle inserts and heel counter inserts which are sandwiched in between the layers of various materials which make up the liner of the boot. Typical skate boots are quite rigid in order to protect the foot and ankle of the wearer from impacts and stress during skating. This rigidity, combined with variations in human anatomy, has as a consequence the creation in many instances of a gap between the skate boot and the wearer's Achilles tendon. The presence of a gap between the skate boot and the wearer's Achilles tendon may result in heel slippage leading to discomfort, irritation and blisters. After considerable use of the skate, however, the leather and other materials naturally soften and become less rigid from repeated flexing, with the result that the upper ankle portion of the boot tends to slump down onto or over the heel counter, typically creating a ridge on the inside of the skate. This ridge bears against the Achilles' tendon, and thus creates a pressure point which results in decreased comfort and potential for blistering or other injury.

It is therefore an object of the present invention to provide for a skate boot construction which reduces or alleviates the gap which may be present between the skate boot and the wearer's Achilles tendon so as to prevent heel slippage leading to discomfort, irritation and blisters.

It is a further object of the present invention to provide for a skate boot construction which increases comfort and protects the wearer from potential blistering or other injury caused by the possible formation of a ridge on the inside of the skate due to wear of the skate boot.

SUMMARY OF THE INVENTION

The present invention generally provides for a boot or ice hockey skate construction where the Achilles tendon and both the internal and external retro malleoli regions of the foot are now fully supported so as to reduce or alleviate the gap which may be present between the skate boot and the wearer's Achilles tendon as well as protecting the wearer's Achilles tendon from a possible pressure point which may result from the wear of the skate.

BRIEF DESCRIPTION OF THE FIGURES

Other applications and advantages of the present invention may be made clear by the following detailed description of several embodiments of the invention. The description makes reference to the accompanying drawings in which.

DETAILED DESCRIPTION

Figure 1:
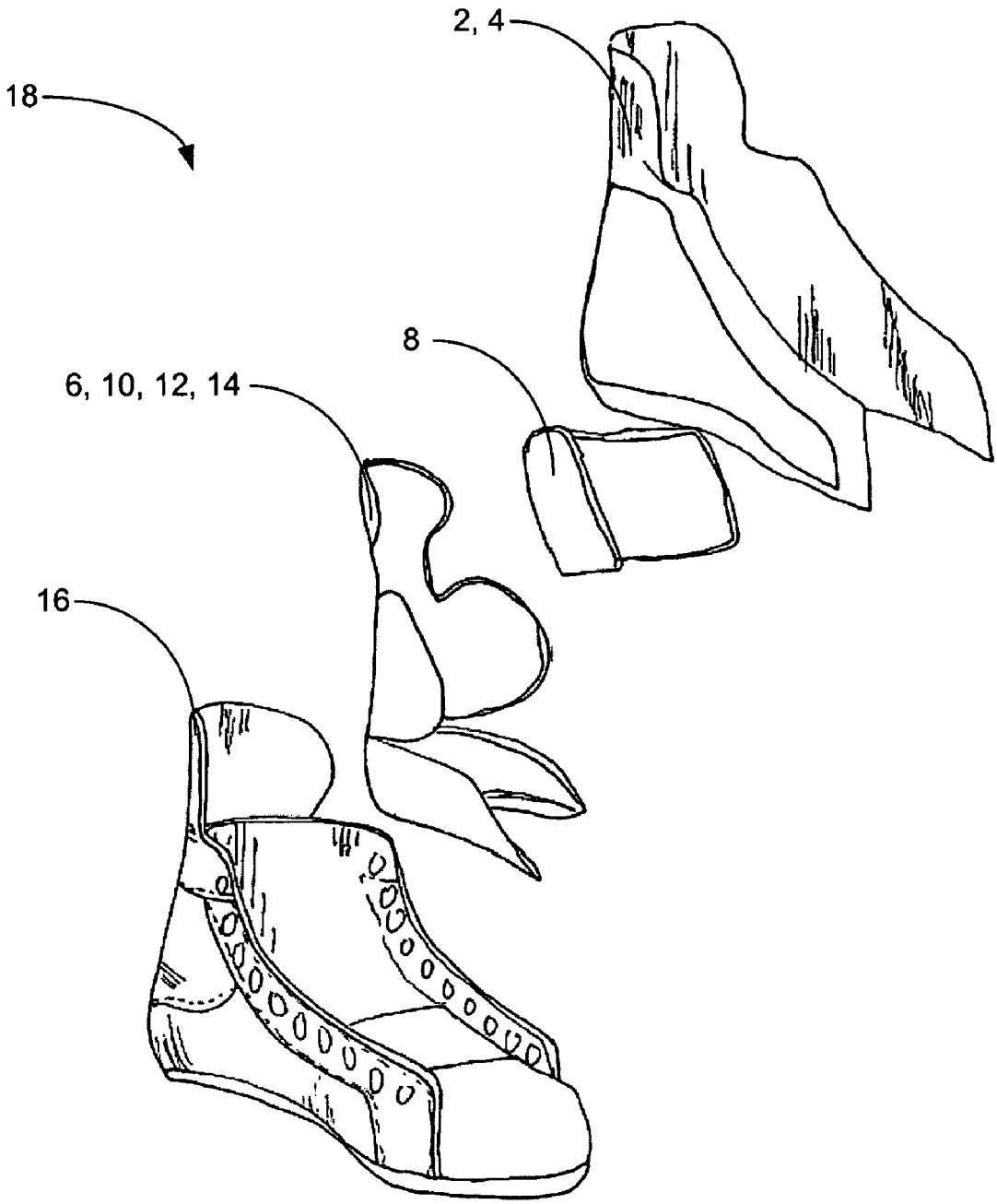
FIG. 1 is an exploded perspective view of an example of a skate boot comprising a skate boot outer, a tendon guard support, an ankle support, a heel counter, a 3-D heel pocket, a tendon guard support foam, a liner foam and a soft material liner.
Figure 2:
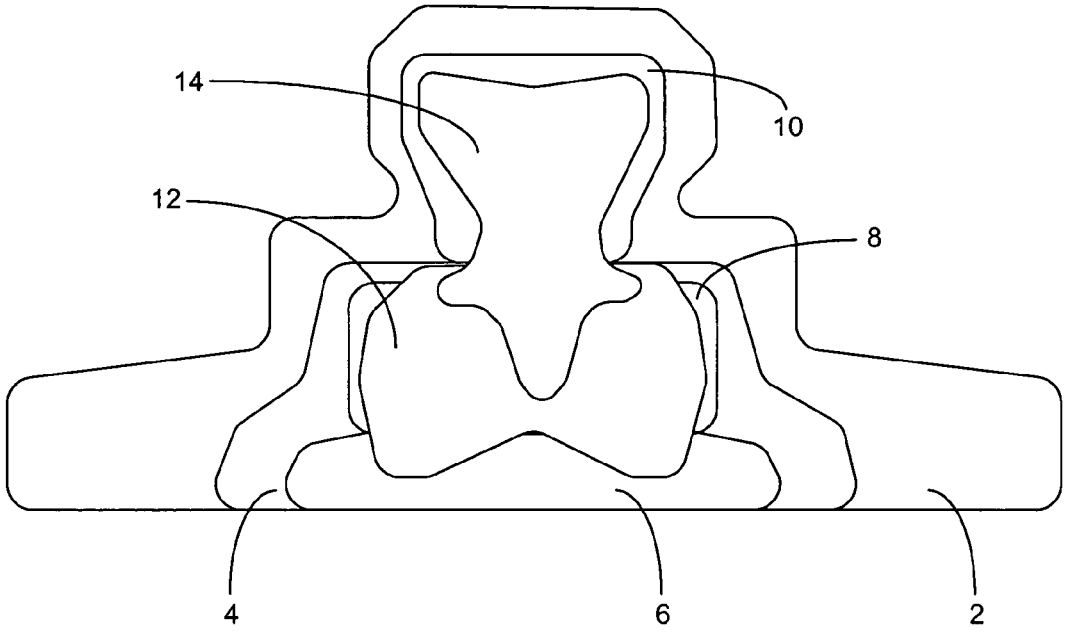
FIG. 2 is a plan view from the outside of a flattened skate boot according to FIG. 1 without the boot outer.
Figure 3:
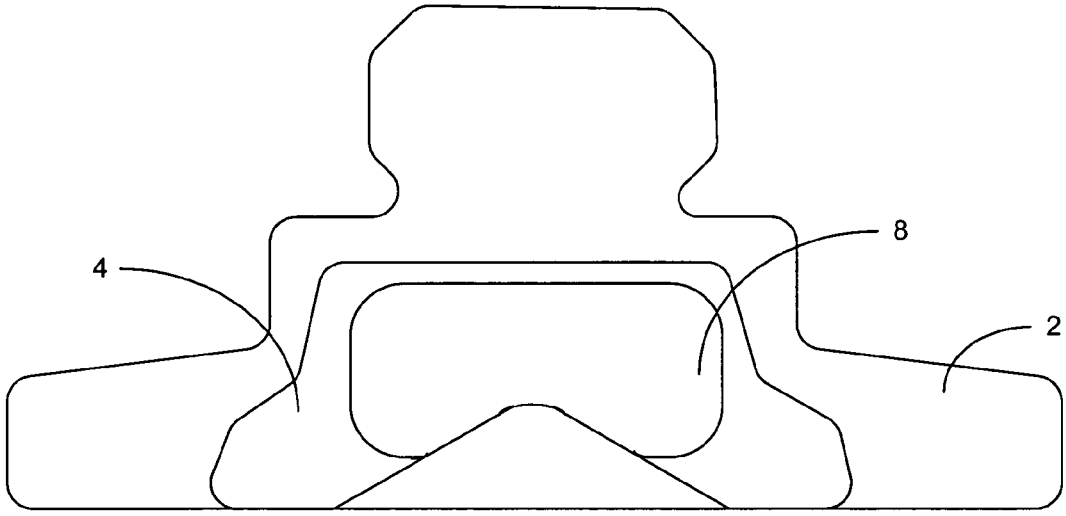
FIG. 3 is a plan view from the outside of a flattened soft material liner and a liner foam over which is positioned a 3-D heel pocket.
Figure 4:
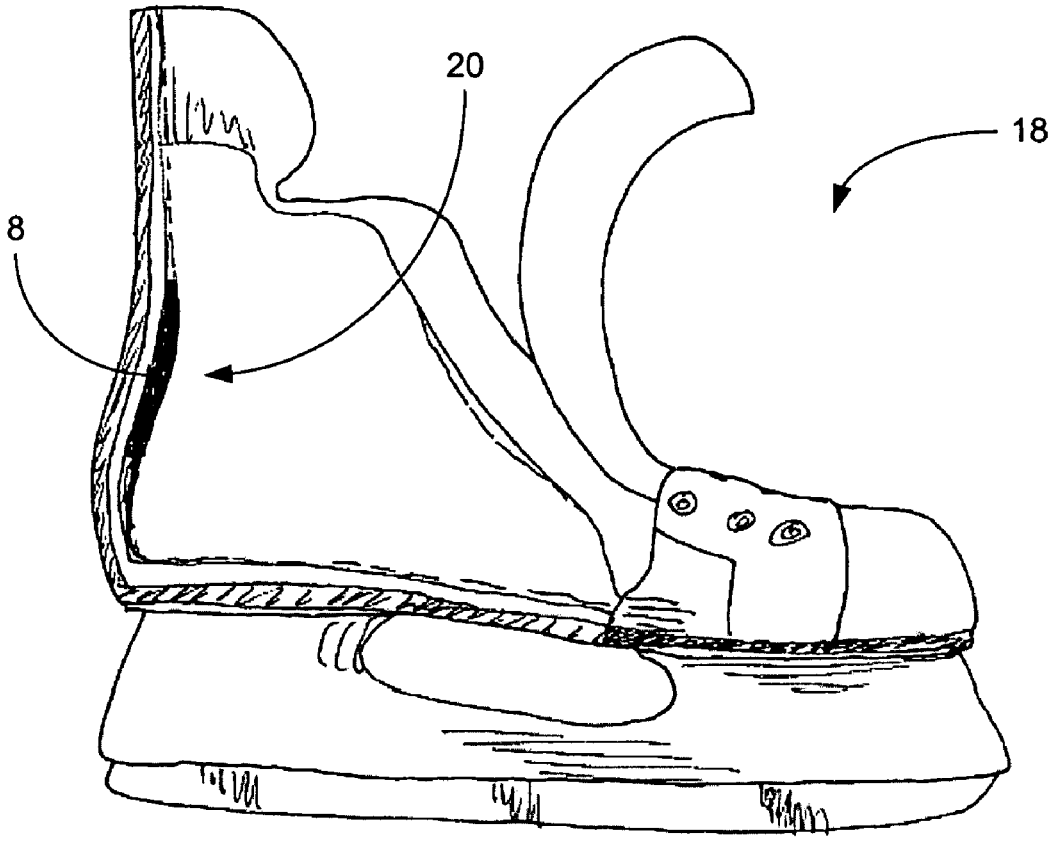
FIG. 4 is a right side elevation of a skate and foot, in cross-section, showing the positioning of the 3-D heel pocket.

FIG. 1 illustrates an exploded perspective view of an example of a skate boot 18 comprising a skate boot outer 16, a tendon guard support 14, an ankle support 12, a heel counter 6, a 3-D heel pocket 8, a tendon guard support foam 10, a liner foam 4 and a soft material liner 2. FIG. 2 further illustrates the positioning of the various components forming the skate boot 18, which in order from the interior to the exterior are: the tendon guard support 14, the ankle support 12, the heel counter 6, the 3-D heel pocket 8, the tendon guard support foam 10, the liner foam 4 and the soft material liner 2. The skate boot outer 16 may be constituted in a number of ways, such as various layers of leather, plastic, ballistic nylon and/or other material portions sewn together. The tendon guard support 14 , an ankle support 12, a heel counter 6, a 3-D heel pocket 8, a tendon guard support foam 10, a liner foam 4 and a soft material liner 2 comprise a particular embodiment of the present invention.

In accordance with the present invention, there is provided a skate boot comprising a boot-shaped outer, a cushioning insert positioned inwardly from the outer, the insert including a middle portion positioned to cover at least part of an Achilles tendon of a wearer of the boot and lateral and medial side portions extending from the middle portion to respectively cover at least part of lateral and medial malleoli of the wearer, and a liner positioned inwardly from the insert, wherein the middle portion has a thickness at least equal to that of the side portions, such as to at least partially fill a gap between the Achilles tendon and the boot.

Also in accordance with the present invention, there is provided a skate boot cushioning insert comprising a middle portion for covering at least part of an Achilles tendon, a lateral side portion extending from the middle portion for covering at least part of a lateral malleoli, a medial side portion extending from the middle portion opposite of the lateral side portion for covering at least part of a medial malleoli, wherein the insert is made of cushioning material, and wherein the middle portion has a thickness at least equal to that of the lateral and medial side portions.

Figure 5:
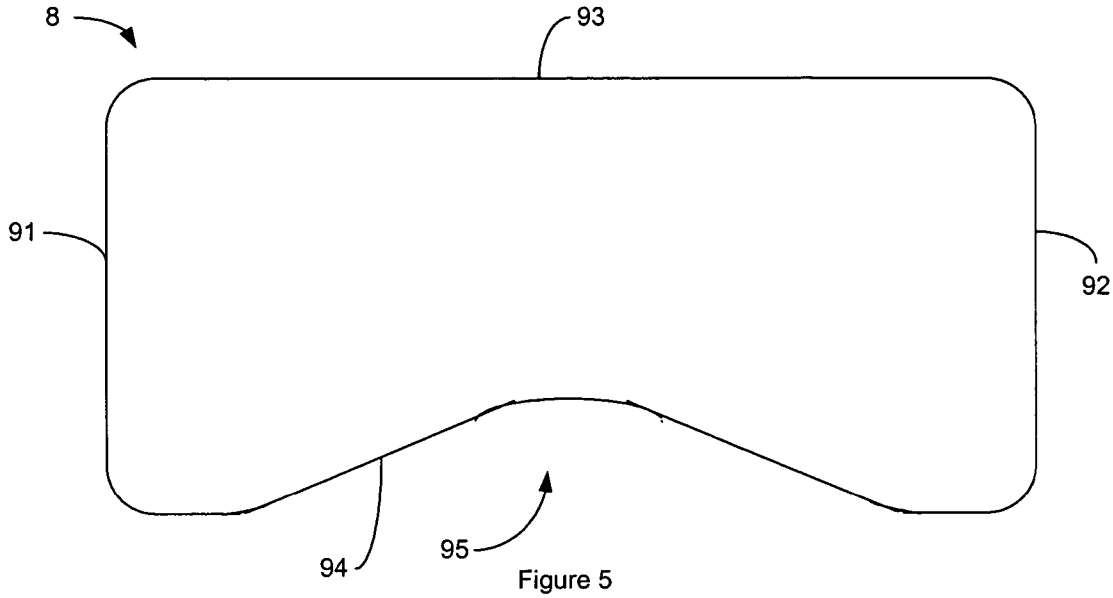
FIG. 5 is a plan view of the 3-D heel pocket laid flat according to a particular embodiment of the present invention.
Figure 6:
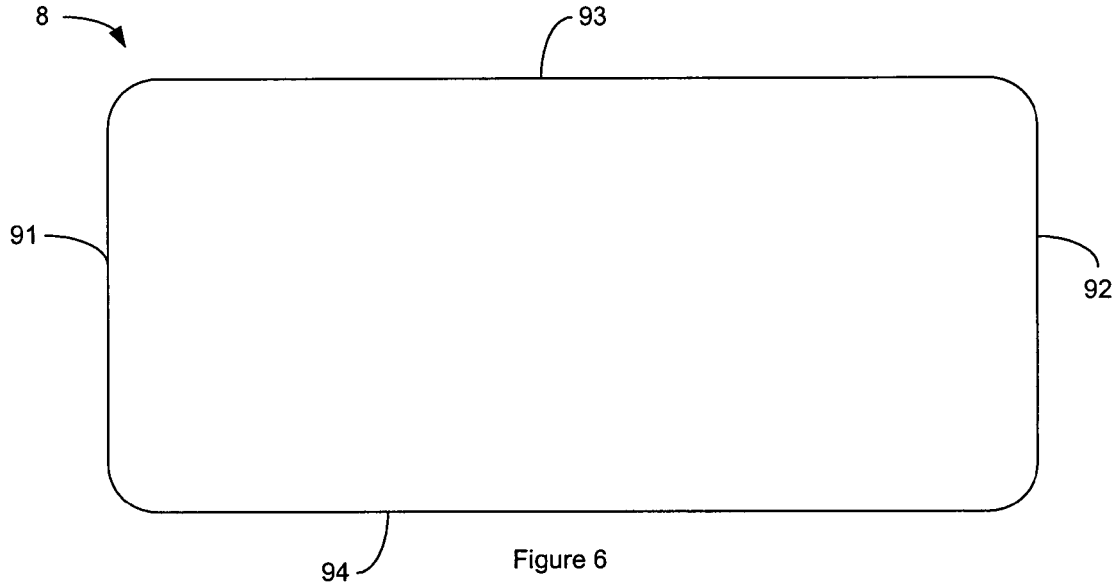
FIGS. 6 to 8 are plan views of the 3-D heel pocket laid flat according to a further embodiments of the present invention.
Figure 7:
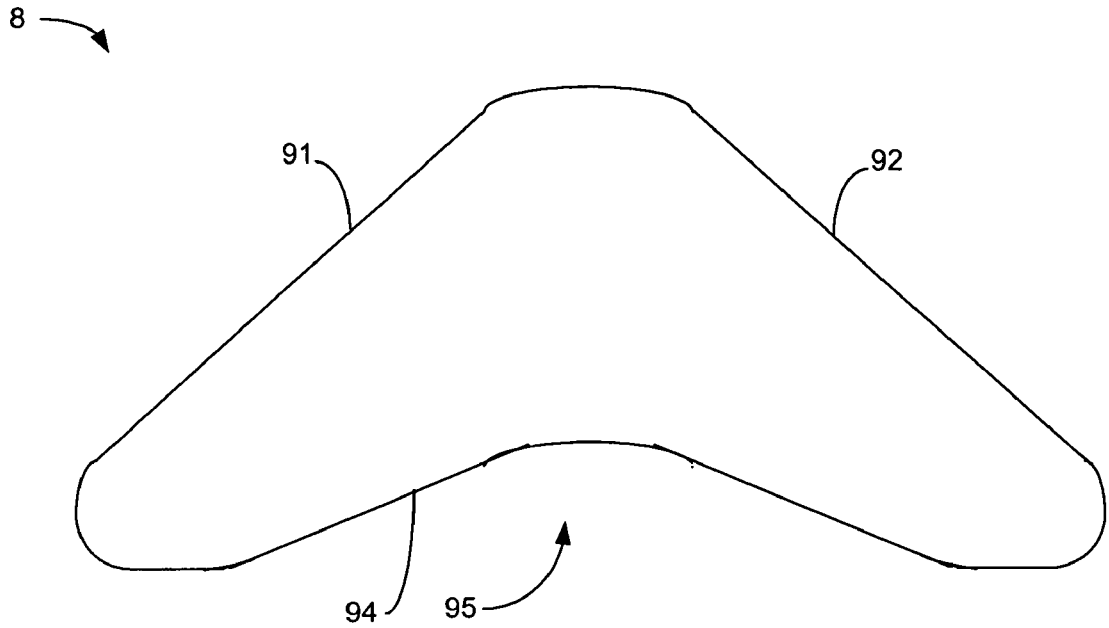
Figure 8:
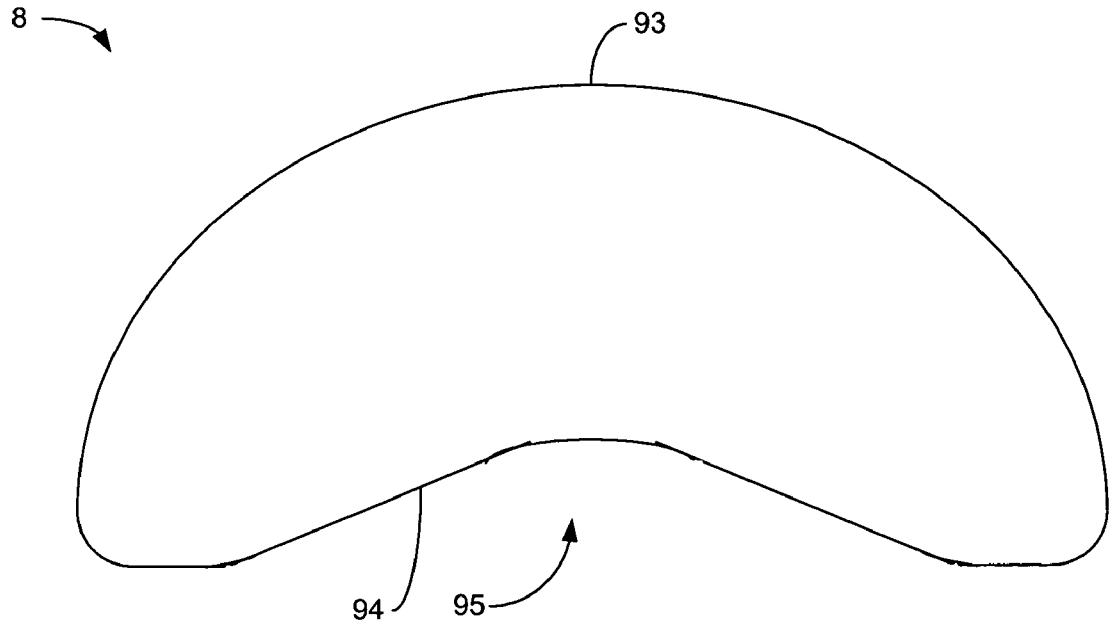
Figure 9:
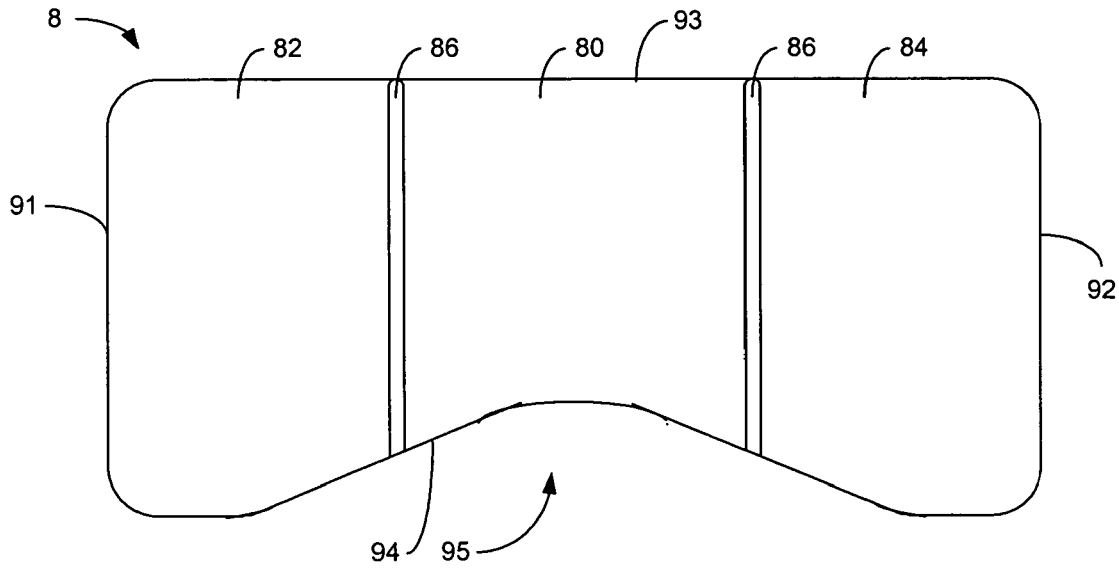
FIGS. 9 and 10 are plan views of the 3-D heel pocket laid flat according to still further embodiment of the present invention, the 3-D heel pocket comprising hinge means.
Figure 10:
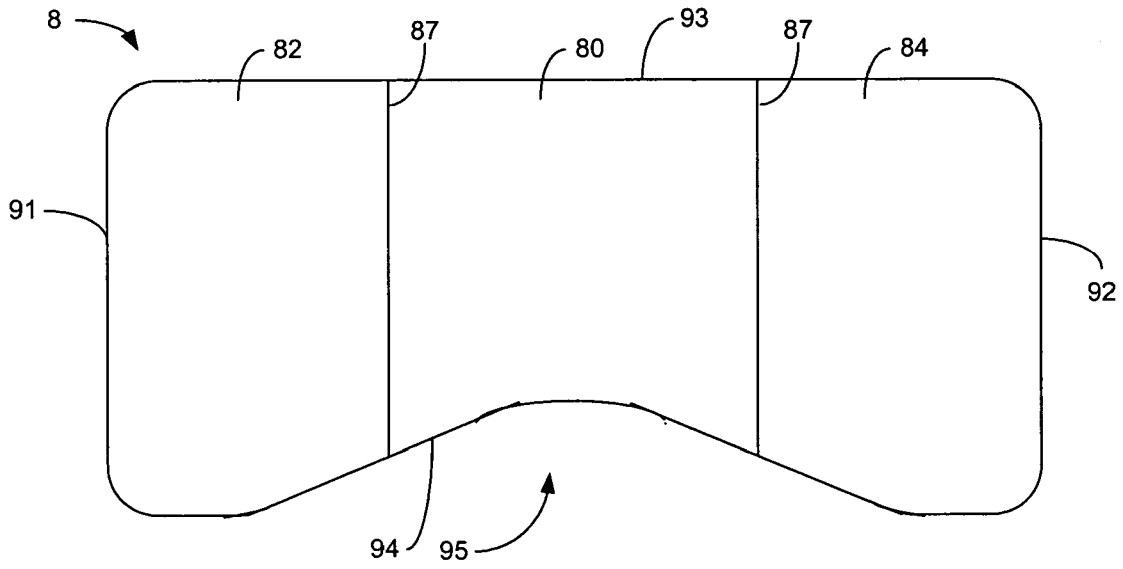
Figure 11:
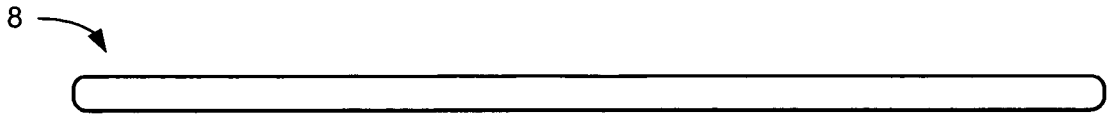
FIG. 11 is a cross-sectional view of the 3-D heel pocket laid flat corresponding to FIGS. 5 and 6.
Figure 12:
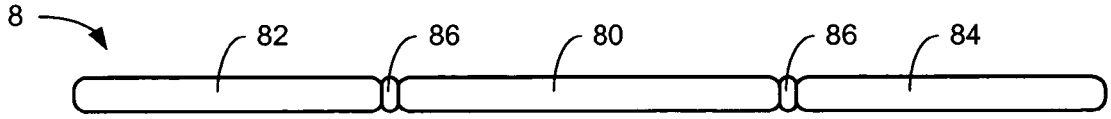
FIGS. 12 and 13 are cross-sectional views of the 3-D heel pocket corresponding to FIGS. 9 and 10 respectively.
Figure 13:
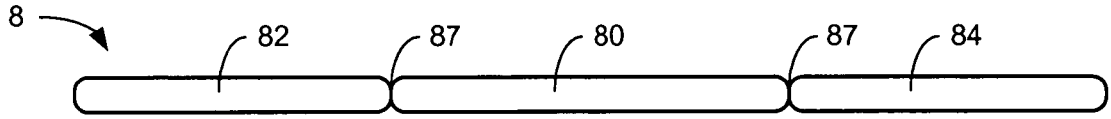
Figure 14:
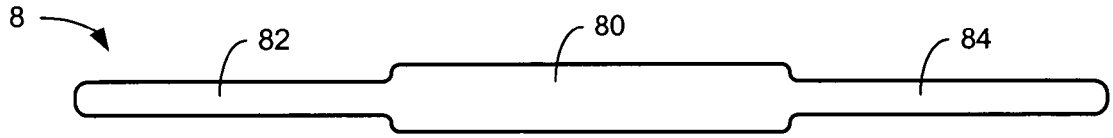
FIG. 14 is a cross-sectional view of the 3-D heel pocket corresponding an alternative embodiment where the pocket is formed of three parts of varying thicknesses
Figure 15:
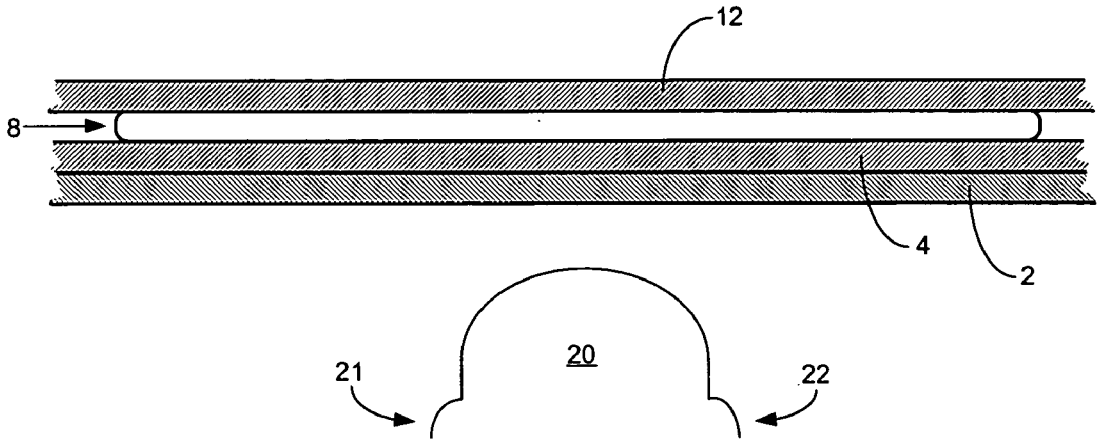
FIGS. 15 to 18 are cross-sectional views of a liner over which is positioned a liner foam, the 3-D heel pocket corresponding to FIGS. 11 to 14, respectively, and an ankle support, in relation to the wearer's Achilles tendon.
Figure 16:
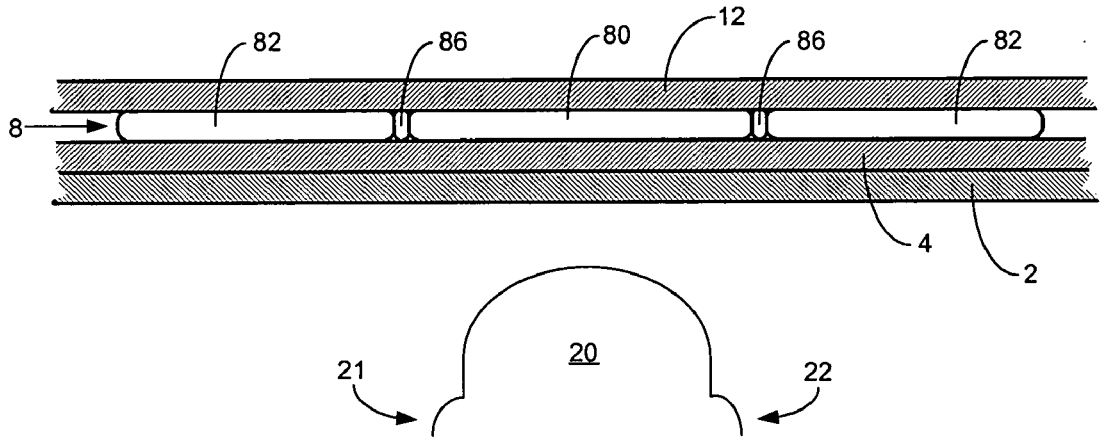
Figure 17:
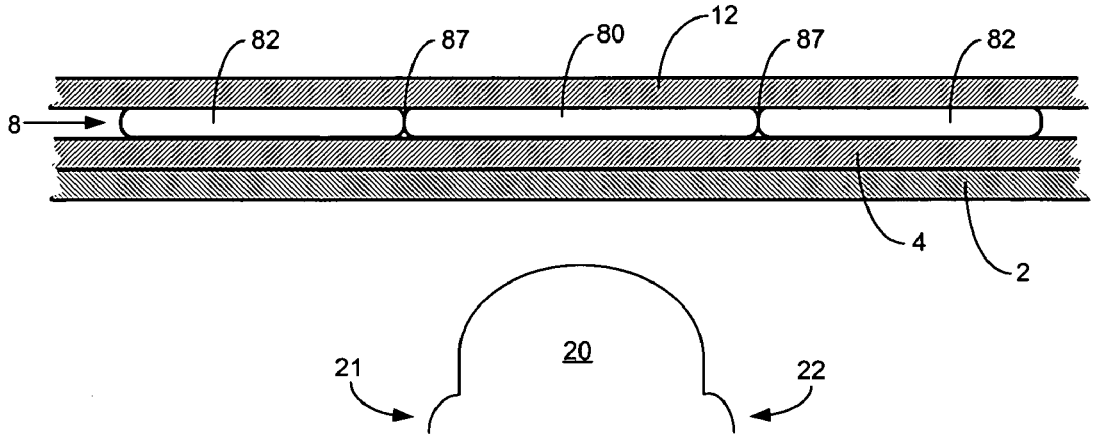
Figure 18:
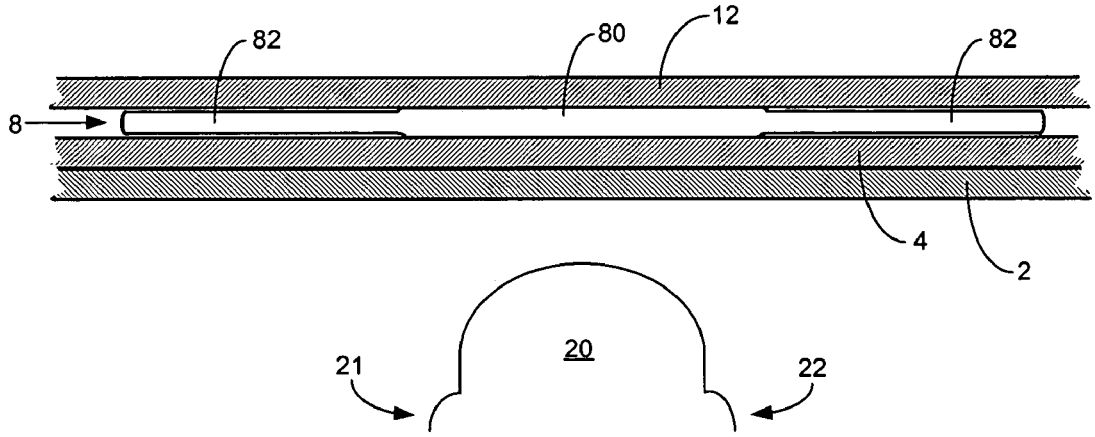

In accordance with a particular embodiment of the present invention, as illustrated in FIG. 5, the 3-D heel pocket 8 may be of relatively constant thickness and comprises a cushioning material such as foam, for example poron or VN foam, or an air or gel pocket. The 3-D heel pocket 8 may be relatively rectangular in shape, comprising a left 91, right 92, top 93 and bottom 94 sides. In order to conform as much as possible to the anatomy of a wearer's ankle shape, the 3-D heel pocket 8 may comprises an indentation 95 in its bottom side 94 that traces the contour of the skate boot 18 wearer's heel. Alternative embodiments of the 3-D heel pocket 8 are illustrated in FIGS. 6 to 10. The embodiment of FIG. 6 is similar to that of FIG. 5 with the exception that its bottom side 94 comprises no indentation. FIG. 7 illustrates another alternative embodiment where the 3-D heel pocket 8 is relatively triangular in shape, comprises a left diagonal 91, right diagonal 92 and bottom 94 sides, with an indentation 95 in its bottom side 94, while FIG. 8 illustrates a further alternative embodiment where the 3-D heel pocket 8 is relatively crescent shaped, comprises a relatively semi-circular top side 93 and a bottom side 94 having an indentation 95. FIGS. 9 and 10 illustrate still further embodiments where the 3-D heel pocket 8 comprises three parts which may be of relatively equal thickness: a left side part 82 and a right side part 84 separated by a middle part 80. The side parts 82, 84 are connected to the middle part 80 by hinge means 86, as illustrated in FIG. 9, or a seam 87 as illustrated in FIG. 10. The hinge means 86 and seam 87 may be especially helpful in the bending of the 3-D heel pocket 8 around the ankle of the wearer, when denser material are used and/or for preventing air or gel (or any other gas or liquid), in the case where the 3-D heel pocket 8 is comprised of such material, from accumulating near the left 91 or right 92 sides because of the bending of the 3-D heel pocket 8. Alternatively, the 3-D heel pocket 8 may comprise three parts of varying thickness: two side parts 82, 84 which may be of relatively equal thickness and a thicker middle part 80. FIG. 11 illustrates a cross-sectional view of the 3-D heel pocket 8 corresponding to FIGS. 5 and 6 while FIGS. 12 and 13 correspond to FIGS. 9 and 10 respectively. FIG. 14 illustrates a cross-sectional view of the 3-D heel pocket 8 corresponding to an alternative embodiment where the three parts of the pocket are of varying thicknesses, i.e. two side parts 82, 84 of relatively equal thickness and a thicker middle part 80. Other embodiments may have further shape, number of parts and/or thickness combinations.

Figure 19:
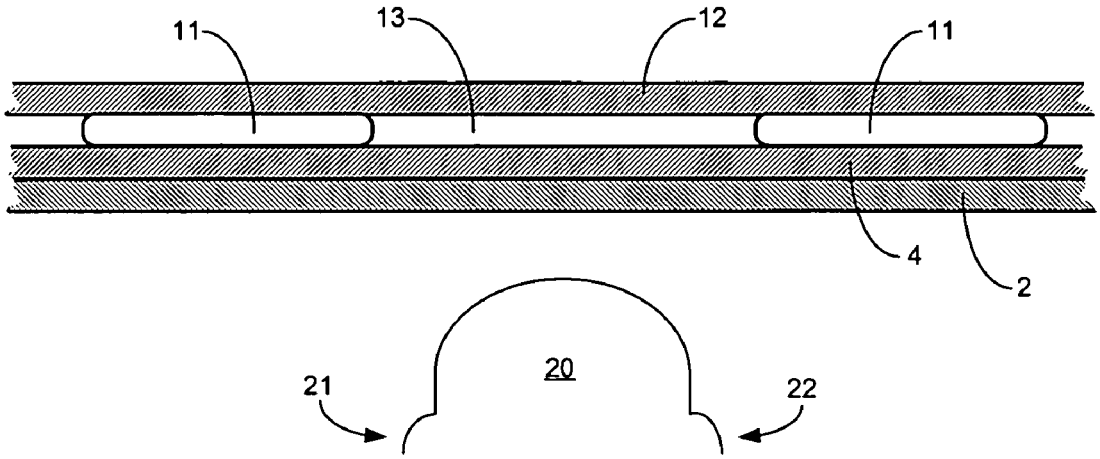
Figure 19 PRIOR ART
FIGS. 19 and 20 are cross-sectional views of a liner over which is positioned a liner foam, an ankle padding means and an ankle support, in relation to the wearer's Achilles tendon, according to prior art.
Figure 20:
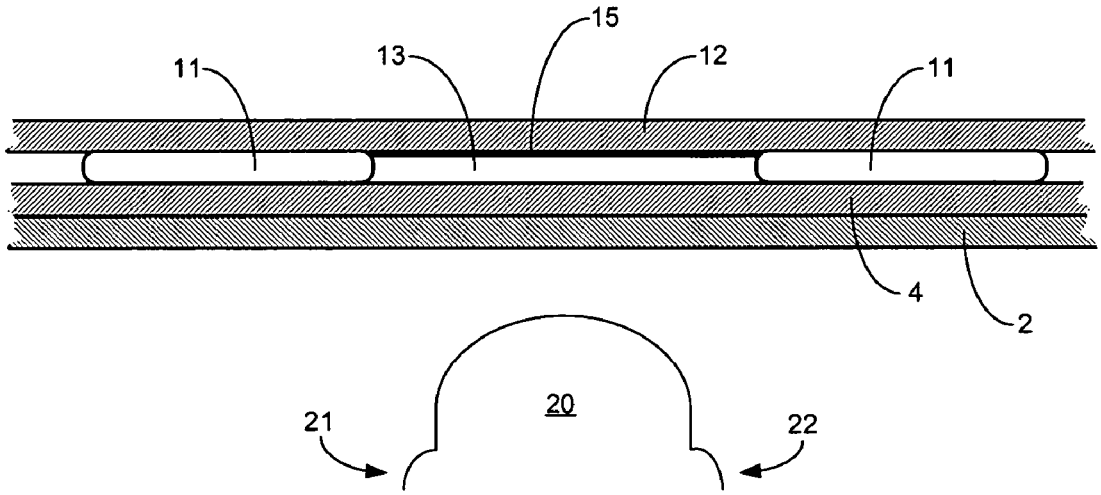
Figure 20 PRIOR ART
Figure 21:
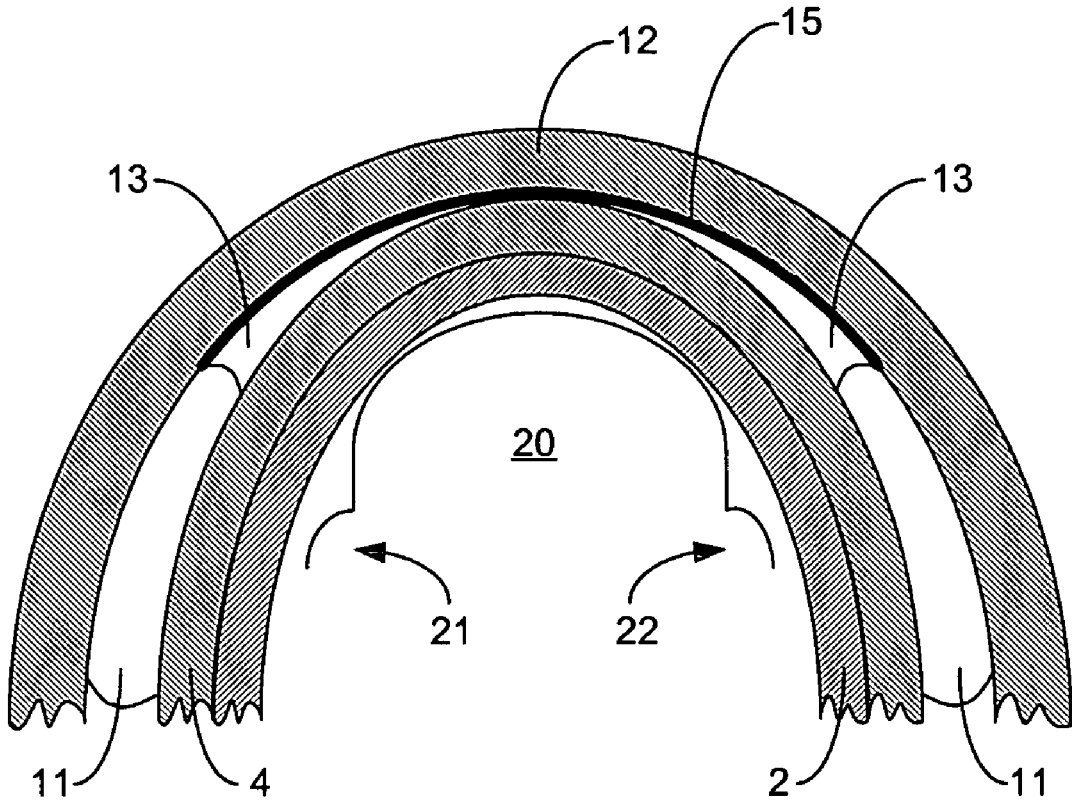
Figure 21 PRIOR ART
FIG. 21 is a bended cross-sectional view of FIG. 20.

FIGS. 15 to 18 illustrate cross-sectional views of various embodiments showing the positioning of the 3-D heel pocket 8, corresponding to FIGS. 11 to 14 respectively. The 3-D heel pocket 8 is shown disposed, between layers of the skate boot 18 in relation to the wearer's Achilles tendon 20. The 3-D heel pocket 8 may be positioned between the liner foam 4 and the ankle support 12. Once the layers of the skate boot 18 are bended so has to conform to the boot outer 16, the 3-D heel pocket 8 covers the Achilles tendon 20 and both the medial 21 and lateral 22 malleoli bones of the wearer's foot. It should be noted that in FIG. 18, the 3-D heel pocket 8 corresponds to an alternative embodiment where the three parts of the pocket are of varying thicknesses, i.e. two side parts 82, 84 of relatively equal thickness and a thicker middle part 80, thus the compression of the 3-D heel pocket 8 between the liner foam 4 and the ankle support 12 results in the 3-D heel pocket 8 being denser at the Achilles tendon 20 region of the wearer's foot than at the internal 21 and external 22 retro malleoli regions. The layers between which the 3-D heel pocket 8 is located depend on the configuration of the skate boot 18 and may vary from one configuration to another. For example, as one example, the skate boot 18 may only comprise a boot outer, a combined tendon guard support/ankle support/heel guard and a soft material liner. Consequently, the 3-D heel pocket 8 may be located between the combined tendon guard support/ankle support/heel guard and the soft material liner FIGS. 19 and 20 illustrate cross-sectional views of the positioning of an ankle padding means 11, according to prior art, between layers of the skate boot 18 in relation to the wearer's Achilles tendon 20. As illustrated in FIG. 19, the ankle padding means 11 are typically positioned between the liner foam 4 and the ankle support 12 and consist of two cushions, one covering the internal retro malleoli region 21 and the other covering the external retro malleoli region 22, leaving a gap between the liner foam 4 and the ankle support 12 at the position of the wearer's Achilles tendon 20. Alternatively, as illustrated by FIG. 20, the two cushions of the ankle padding means 11 may connected by a middle part 15 considerably thinner than the ankle padding means 11 cushions, leaving once again a gap 13 between the liner foam 4 and the ankle support 12 at the position of the wearer's Achilles tendon 20. FIG. 21 illustrates the presence of gap 13 when the layers of the skate boot 18, according to the prior illustrated in FIG. 20, are bended so has to conform to the boot outer 16.

It will be appreciated that the above description relates to the preferred embodiment by way of examples only. Certain variations on the invention will be obvious to those knowledgeable in the field, and such obvious variations are within the scope of the invention as claimed, whether or not expressly described herein.

For example, it should be clearly appreciated that the invention is not restricted to the specific configuration of liner components as illustrated herein. Many variations in shape or positioning may be contemplated while still employing the principle of this invention.

Reasonable variations and modifications are possible within the scope of the foregoing disclosure, the drawings and the appended claims to the invention.

What is claimed is:

1. A skate boot comprising:

a boot-shaped outer;

a support guard positioned inwardly from the outer, the guard including a tendon guard support, an ankle support and a heel counter:

a cushioning insert positioned inwardly from the support guard, the insert including a middle portion positioned to cover at least part of an Achilles tendon of a wearer of the boot and lateral and medial side portions extending from the middle portion to respectively cover at least part of lateral and medial malleoli of the wearer; and a liner positioned inwardly from the insert;

wherein the middle portion has a thickness at least equal to that of the side portions, such as to at least partially fill a gap between the Achilles tendon and the boot.

2. The skate boot according to claim 1, wherein the middle and side portions of the insert are integral with one another.

3. The skate boot according to claim 1, wherein the side portions are connected to the middle portion through one of hinge means and a scam.

4. The skate boot according to claim 1, wherein the insert has a rectangular shape with an indentation defined along a bottom side thereof, the indentation being shaped to trace a contour of a heel of the wearer.

5. The skate boot according to claim 1, wherein the insert has a substantially triangular shape with an indentation defined along a bottom side thereof, the indentation being shaped to trace a contour of a heel of the wearer.

6. The skate boot according to claim 1, wherein the insert is crescent shaped such as to define an indentation along a bottom side thereof, the indentation being shaped to trace a contour of a heel of the wearer.

7. The skate boot according to claim 1, wherein the middle portion is thicker than the side portions.

8. The skate boot according to claim 1, wherein the insert completely fills the gap between the Achilles tendon and the boot.

* * * * *

UNITED STATES PATENT AND TRADEMARK OFFICE

CERTIFICATE OF CORRECTION

PATENT NO. : 7,373,742 B2
APPLICATION NO. : 11/067019
DATED : May 20, 2008
INVENTOR(S) : Stephen Murphy It is certified that error appears in the above-identified patent and that said Letters Patent is hereby corrected as shown below:

Column 4

Claim 3; line 67 “scam” should be --seam--.

Signed and Sealed this

Second Day of September, 2008

JON W. DUDAS
*Director of the United States Patent and Trademark Office*